US006768075B2

(12) United States Patent
Kikuchi

(10) Patent No.: US 6,768,075 B2
(45) Date of Patent: Jul. 27, 2004

(54) MEMBRANE SWITCH AND DIAL OPERATION MEMBER EQUIPPED THEREWITH

(75) Inventor: Tomohiko Kikuchi, Tokyo (JP)

(73) Assignee: Teac Corporation, Tokyo (JP)

( * ) Notice: Subject to any disclaimer, the term of this patent is extended or adjusted under 35 U.S.C. 154(b) by 0 days.

(21) Appl. No.: 10/444,594

(22) Filed: May 23, 2003

(65) Prior Publication Data

US 2003/0221946 A1 Dec. 4, 2003

(30) Foreign Application Priority Data

May 31, 2002 (JP) ..... 2002-160651

(51) Int. Cl.[7] ..... H01H 1/10
(52) U.S. Cl. ..... 200/517; 200/314
(58) Field of Search ..... 200/510–517, 200/520, 314, 341

(56) References Cited

U.S. PATENT DOCUMENTS 4,987,275 A * 1/1991 Miller et al. ..... 200/5 A
5,152,392 A * 10/1992 Iwasa ..... 200/517
6,392,178 B1 * 5/2002 Kuratani ..... 200/512
6,486,427 B1 * 11/2002 Pruvot ..... 200/406
6,670,750 B2 * 12/2003 Hanahara et al. ..... 313/511

FOREIGN PATENT DOCUMENTS

JP 06-034140 2/1994

* cited by examiner

*Primary Examiner*—Elvin Enad
*Assistant Examiner*—Lisa Klaus
(74) *Attorney, Agent, or Firm*—Katten Muchin Zavis Rosenman

(57) ABSTRACT

A membrane switch comprises a lower contact sheet having a first conductor, an upper contact sheet having a second conductor, and a spacer interposed therebetween. An application of a press force onto contact areas in the upper contact sheet causes the upper contact sheet to be bent, so that at least one of the contact areas and a corresponding contact area in the lower contact sheet come in contact with each other. The first and second conductors are always connected to each other, since a conductive area in the lower contact sheet is always in contact with a conductive area in the upper contact sheets. Hence, the contact of at least one of the contact areas with the corresponding contact area allows the membrane switch to turn on (ON) by a very small press force and therefore the reliability of the switch operation to be significantly enhanced.

3 Claims, 10 Drawing Sheets

MEMBRANE SWITCH AND DIAL OPERATION MEMBER EQUIPPED THEREWITH

BACKGROUND OF THE INVENTION

1. Field of the Invention

The present invention relates to a membrane switch, which is produced by interposing a spacer between flexible films having conductor circuits formed by the printing or the like. The present invention also relates to a dial operation member, which is equipped with such a membrane switch.

2. Description of the Related Art

Such a membrane switch is used as a switch including electrical circuits, which are formed by printing a conductive paste onto flexible substrates, such as polyester films or the like. The membrane switch is used as a lightweight, thin and flexible switch, and therefore is particularly useful for mass production. These significant features of the membrane switch allow it to be used in a wide application field, for instance, in a keyboard for a computer, a home electrical appliance, a portable communication device, such as a cellar phone, a component for an automobile, a musical instrument, a medical appliance and others.

FIG. 7 is a plan view of a conventional membrane switch. FIG. 8 is a plan view of a lower contact sheet in the conventional membrane switch. FIG. 9 is a plan view of an upper contact sheet in the conventional membrane switch. FIG. 10A is a sectional view of the conventional membrane switch in the non-conductive state, and FIG. 10B is a sectional view of the conventional membrane switch in the conductive state.

Such a conventional membrane switch 110 comprises a lower contact sheet 111, an upper contact sheet 112, a spacer 113, a connector 114 and others, as shown in FIGS. 7–10. The lower contact sheet 111 includes a conductor 111*a* and a projection portion 111*b*, as shown in FIG. 8. The conductor 111*a* includes several sets of paired contact areas 111*c* and 111*d*, each end of which is ramified in the form of an approximately U shape. The upper contact sheet 112 includes circular contact areas 112*a*, which are used to come into contact with the corresponding contact areas 111*c* and 111*d* in the conductive state, as shown in FIG. 9. In the spacer 113, there are through holes 113*a*, through which paired contact areas 111*c* and 111*d* on the side of the lower contact sheet 111 and corresponding contact areas 112*a* on the side of the upper contact sheet 112 come into contact with each other in the conductive state, as shown in FIG. 7. The projection portion 111*b* which is part of the lower contact sheet 111 including part of the conductor 111*a* is inserted into the connector 114.

In the following, the function of the conventional membrane switch will be described.

When trying to push a projection portion 109*d* to bend the upper contact sheet 112 in the lower direction by pushing a projection portion 109*d*, as shown in FIG. 10A, the contact area 112*a* is in contact with the paired contact areas 111*c* and 111*d*, as shown in FIG. 10B. Accordingly, the contact area 112*a* is directly connected to the paired contact areas 111*c* and 111*d*, so that the membrane switch 110 turns on in the conductive state (the ON state).

In the conventional membrane switch 110, there is a problem in which a decrease in the press force acting to the upper contact sheet 112 occasionally causes the contact area 112*a* to come in contact with only one of the paired contact areas 111*c* and 111*d*, so that the membrane switch 110 does not turn on in the conductive state. Furthermore, in order to securely connect the contact area 112*a* with both the contact areas 111*c* and 111*d* in the conventional membrane switch 110, it is necessary that the projection portion 109*d* made of a resilient material, such as gum or the like, presses against the upper contact sheet 112 with a press force greater than a predetermined force. This also provides an increase in the production cost, since the number of the parts constituting the membrane switch 110 is inevitably increased.

SUMMARY OF THE INVENTION

Accordingly, it is an object of the present invention to provide a membrane switch capable of turning on even with a very small weight.

It is another object of the present invention to provide a dial operation member, which is equipped with such a membrane switch.

In accordance with a first aspect of the invention, a membrane switch comprises, (a) a first base element made of an electrical insulation elastic material, the first base element having a first conductor including at least one press contact area and at least one permanent contact area on a surface of the first base element;

(b) a second base element made of an electrical insulation material, the second base element having a second conductor and a third conductor on a surface facing the surface of the first base element, the second conductor including at least one press contact area in accordance with the arrangement of the at least one press contact area in the first conductor, and the third conductor including at least one permanent contact area in accordance with the arrangement of the at least one permanent contact area in the first conductor, the second base element further having a connector section for connecting the second and third conductors to an external circuit; and (c) a spacer made of an electrical insulation material, the spacer being interposed between the first base element and the second element, the spacer having through holes at positions corresponding to those both in the at least one press contact area and the at least one permanent contact area of the first and second base elements.

In accordance with a second aspect of the invention, a membrane switch comprises, (a) a first base element made of an electrical insulation elastic material, the first base element having a first conductor including at least one press contact area, a second conductor including at least one permanent contact area and a connector section for connecting the first and second conductors to an external circuit on a surface of the first base element;

(b) a second base element made of an electrical insulation material, the second base element having a third conductor on the surface facing the surface of the first base element, the third conductor including at least one press contact area in accordance with the arrangement of the at least one press contact area disposed in the first conductor and the at least one permanent contact area in accordance with the arrangement of the at least one permanent contact area disposed in the first conductor; and (c) a spacer made of an electrical insulation material interposed between the first base element and the second base element, the spacer having through holes in accordance with the arrangement of the at least one press contact area and the at least one permanent contact area.

In accordance with a third aspect of the invention, a dial operation member comprises, (a) a shaft;

(b) a bearing through which the shaft passes;

(c) a dial body fixed to the shaft and rotatably supported around the center axis of the shaft;

(d) a press member for switch disposed so at to face the dial body for switching, the press member having at least one press projection portion for switching; and (e) one of the above mentioned membrane switches, wherein at least one press portion for switching is disposed so as to face the at least press projection for switching in the press member for switch.

Further objects, features and advantages of the present invention will become apparent from the following description of the preferred embodiment with reference to the accompanying drawings.

DETAILED DESCRIPTION OF THE PREFERRED EMBODIMENTS

Referring now to the accompanying drawings, an embodiment of the invention will be described in detail.

Figure 1:
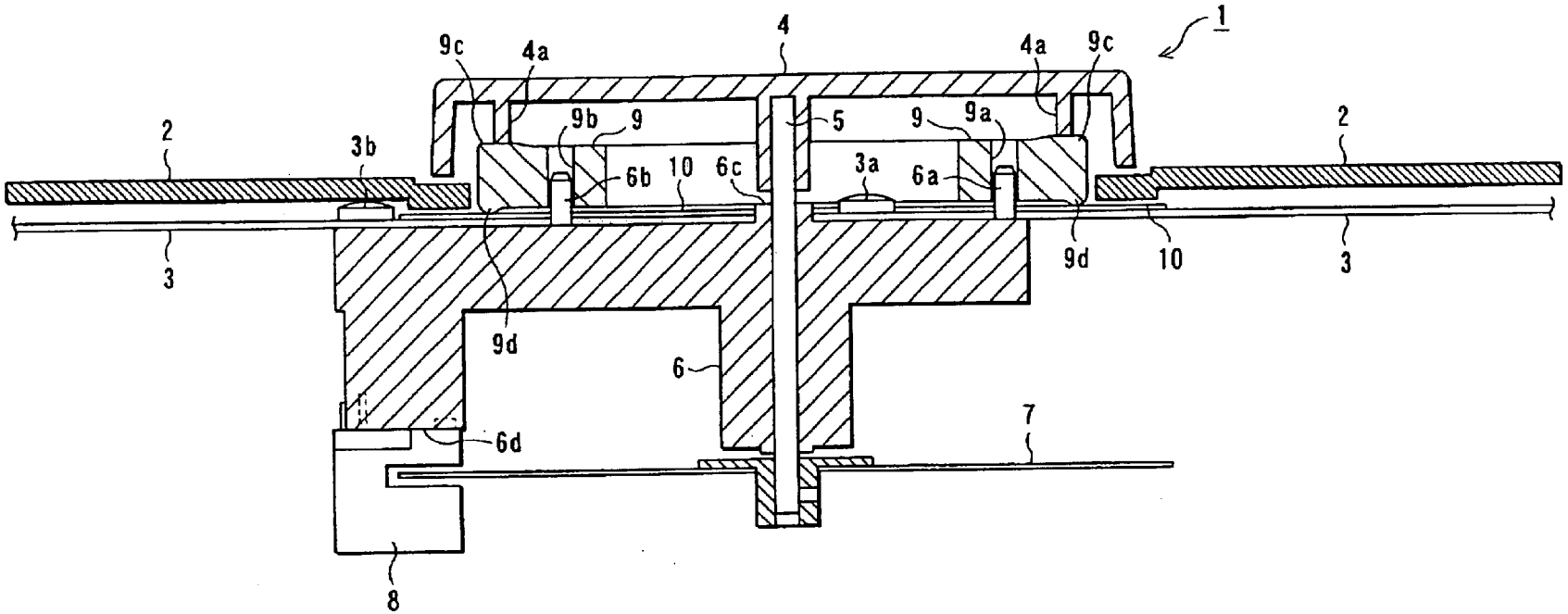
FIG. 1 is a sectional view of an operation dial onto which a membrane switch according to the invention is mounted.

FIG. 1 is a sectional view of a dial operation member 1, which is equipped with a membrane switch 10 according to the invention.

The dial operation member 1 is used as a device, which has a touch sensing function and is rotatably operated. The dial operation member 1 is fixed to a chassis 3 of an electric appliance or the like, wherein the chassis 3 is covered by a front panel 2. The dial operation member 1 is normally used, for instance, in a CD player for DJ, in which case, the dial operation member 1 is operated to temporarily pause the driving of the CD in the playback state. As shown in FIG. 1, the dial operation member 1 substantially comprises a dial 4, a shaft 5, a bearing 6, an encoder disk 7, a photo-interrupter 8, a force transmission element 9 and the membrane switch 10.

The dial 4 is used as a disk-shaped element, which is capable of being rotatably manipulated and is made of, for instance, stiff plastic material, aluminum die cast or the like, and the dial 4 has an arch-shaped projection portion 4*a* in the circumferential direction.

The shaft 5 is used as an element for rotatably supporting the dial 4, in which case, the dial 4 is fixed to an end of the shaft 5 and the encoder disk 7 is fixed to the other end of the shaft 5.

The bearing 6 is used as an element for rotatably supporting the shaft 5, in which case, pins 6*a* and 6*b* as well as a projection portion 6*c* are formed on the upper part of the bearing 6 and an adaptation element 6*d* is disposed in the lower portion of the bearing 6. The bearing 6 is fixed to the bottom surface of the chassis 3 by screws 3*a* and 3*b*. The encoder disk 7 is used as a rotary disk, which has a plurality of slits arranged in the same spacing in the circumferential direction, and is capable of being rotated together with the dial 4.

The photo-interrupter 8 is used as a device for sensing the speed of revolution and the angular position of the encoder disk 7, wherein, one of the slits in the encoder disk 7 passes through a space between a light-emitting element and a light-receiving element. The photo-interrupter 8 is fixed to the adaptation element 6*d*.

The force transmission element 9 is used as an element for transmitting the press force applied onto the dial 4 to the membrane switch 10, and is constituted by a material such as stiff plastic material, aluminum die cast, or the like in a disk-shape, as similarly to the dial 4. The force transmission element 9 includes holes 9*a* and 9*b* for receiving the pins 6*a* and 6*b*, a contact portion 9*c* serving to come into contact with the projection portion 4*a* and a projection portion 9*d* serving to come into contact with the membrane switch 10.

In FIG. 1, a gap having a very small spacing is formed between the dial 4 and the bearing 6. Similarly, a gap having a very small spacing is formed between the encoder disk 7 and the bearing 6, thereby enabling the dial 4 and the encoder disk 7 to be moved by a very small amount in the axial direction of the shaft 5. The gaps are designed such that the encoder disk 7 and the photo-interrupter 8 come into no contact with each other. When the surface of the dial 4 is pushed downward, the press force acts to push down the force transmission element 9 via the projection portion 4*a*. The force transmission element 9 pushes down the membrane switch 10 in response to the movement of the force transmission element 9. When stopping the pushing of the dial 4, the force transmission element 9 is pushed upwards due to the resilient force of the membrane switch 10. In conjunction with this movement, the dial 4 is also pushed upwards.

Figure 2:
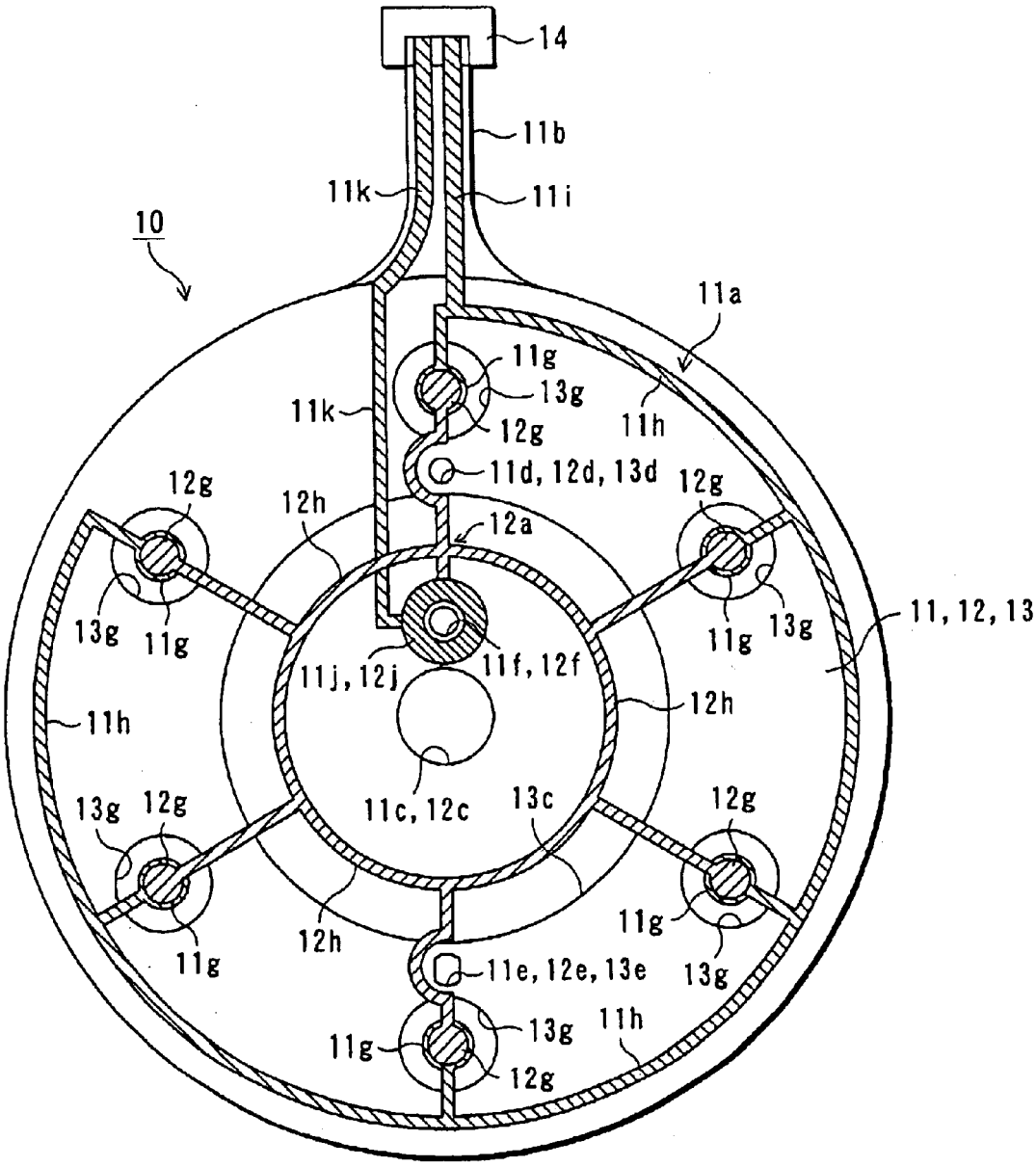
FIG. 2 is a plan view of the membrane switch according to the invention.
Figure 3:
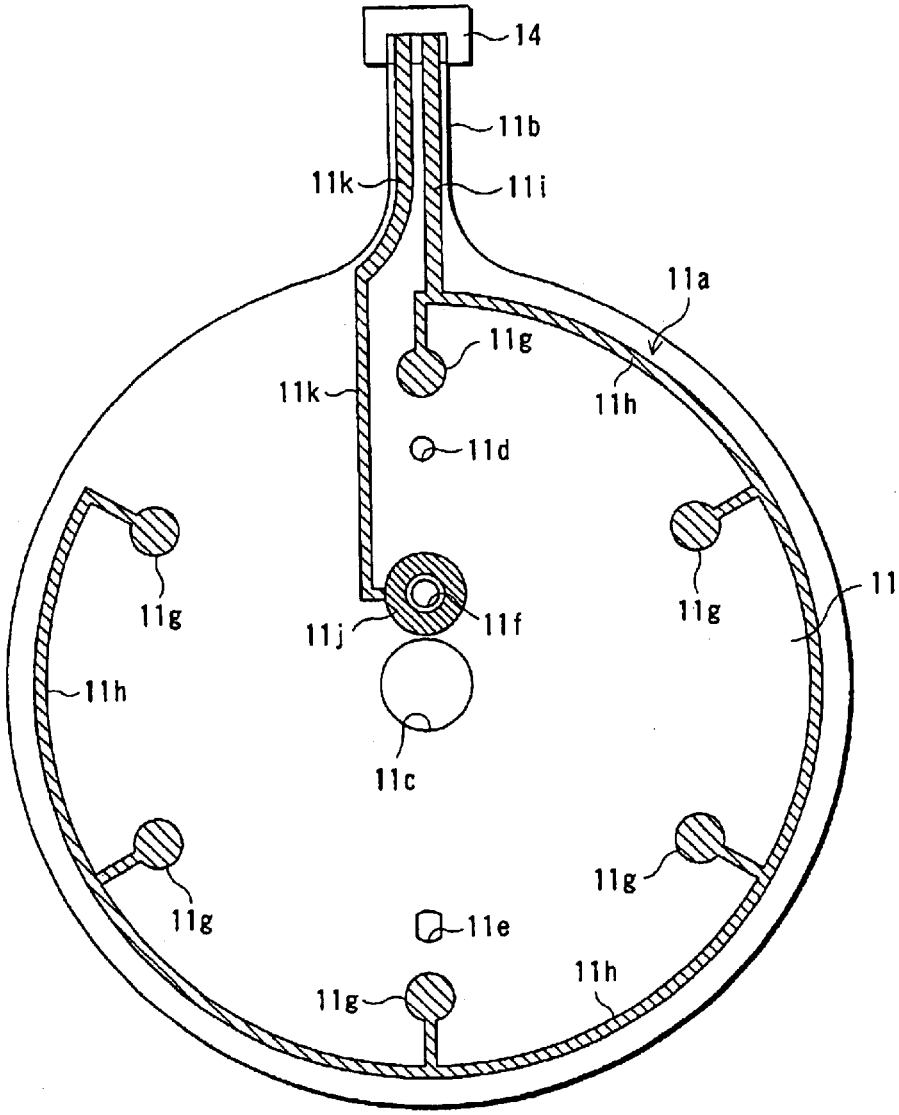
FIG. 3 is a plan view of a lower contact sheet in the membrane switch according to the invention.
Figure 4:
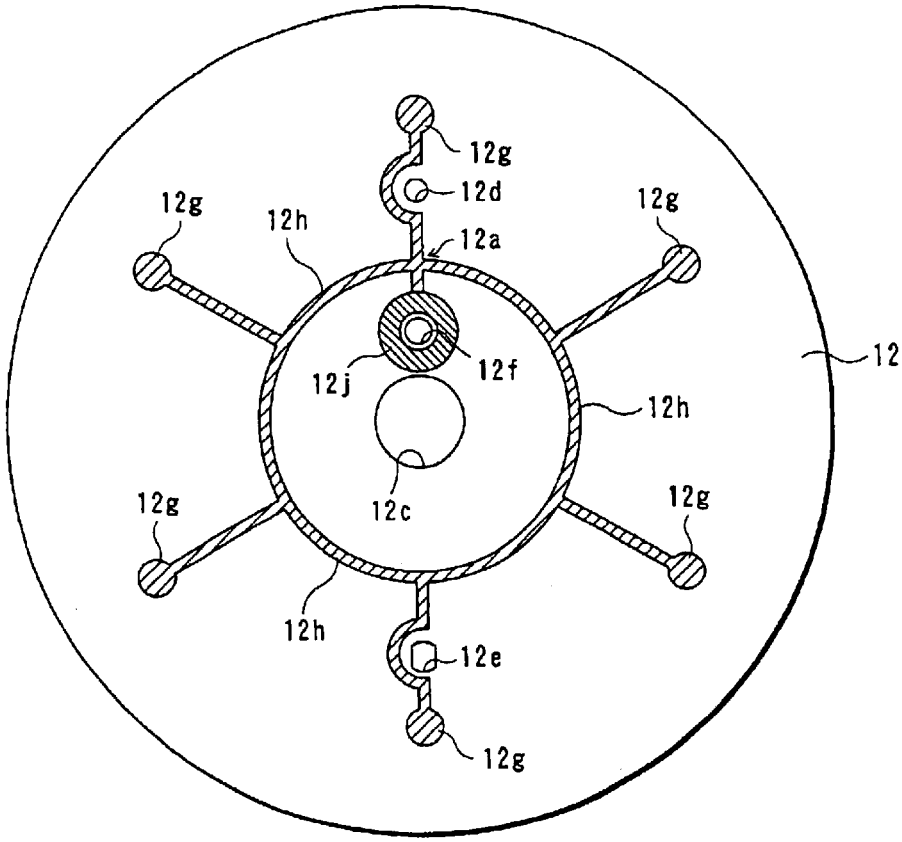
FIG. 4 is a plan view of an upper contact sheet in the membrane switch according to the invention.
Figure 5:
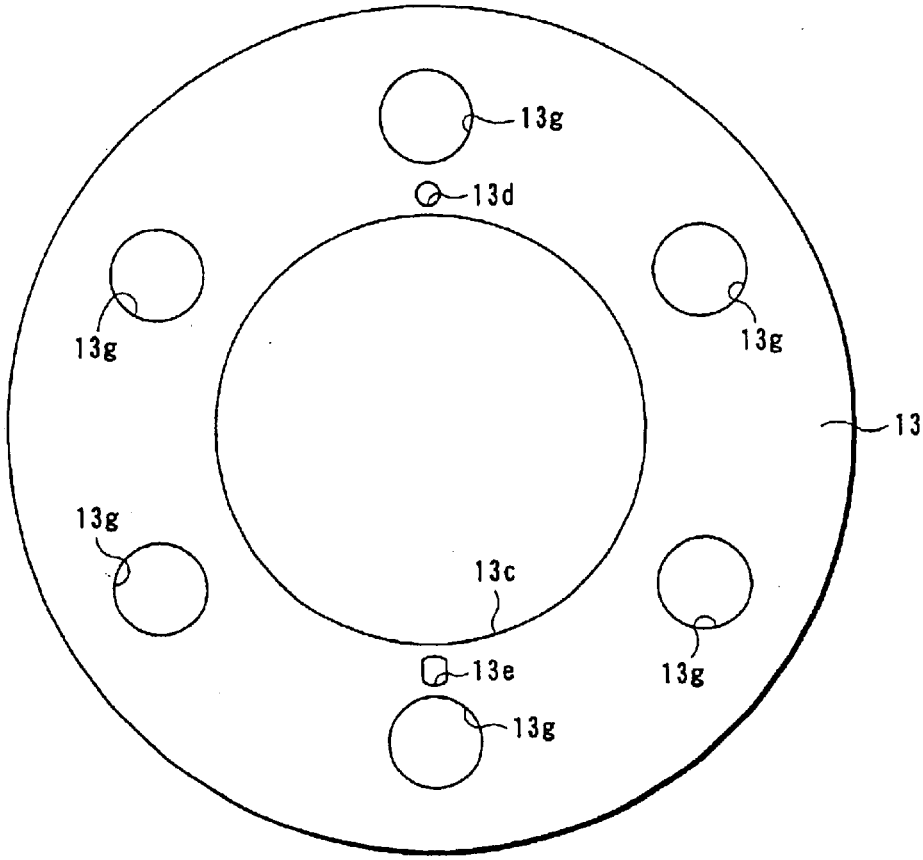
FIG. 5 is a plan view of a spacer in the membrane switch according to the invention.

FIG. 2 is a plan view of the membrane switch according to the invention. FIG. 3 is a plan view of the lower contact sheet in the membrane switch according to the invention. FIG. 4 is a plan view of the upper contact sheet in the membrane switch according to the invention. FIG. 5 is a plan view of the spacer in the membrane switch according to the invention.

The membrane switch 10 is used as a switch, which is formed by interposing a spacer 13 between the lower contact sheet 11 including a conductor 11*a* and the upper contact sheet 12 including a conductor 12*a*, and serves to connect one or more of contact areas 11*g* in the conductor 11*a* to one or more of corresponding contact areas 12*g* in the conductor 12*a* with the aid of the press force. As shown in FIGS. 2–5, the membrane switch 10 comprises the lower contact sheet 11, the upper contact sheet 12, the spacer 13 and a connector 14.

The lower contact sheet 11 is a base element including the conductor 11*a*. The lower contact sheet 11 is formed by printing a conductive paste prepared by mixing conductive fine particles of copper, carbon, silver or the like with a binder resin is printed onto a polyester film. As shown in FIG. 3, the conductor 11*a* for supplying an electrical current, a projection portion 11*b* inserted into the connector 14, a through hole 11*c* for receiving the projection portion 6*c* in FIG. 1, through holes 11*d* and 11*e* for receiving the corresponding pins 6*a* and 6*b* and a through hole 11*f* for receiving a screw 3*a* are formed on the lower contact sheet 11.

The conductor 11*a* is constituted in a wiring pattern by conductors formed on the surface of the lower contact sheet 11. The conductor 11*a* comprises six circular contact areas 11*g* coaxially arranged at a radial distance from the center of the lower contact sheet 11 with the same circumferential spacing; a conductor portion 11*h* formed in the circumferential direction of the lower contact sheet 11 for connecting to the contact areas 11*g*; a connection conductor portion 11*i* projecting from the conductor portion 11*h* toward the projection portion 11*b*; an annular conductive area 11*j* for receiving the screw 3*a*; and another connection conductor portion 11*k* projecting from the annular conductive area 11*j* toward the projection portion 11*b*.

The upper contact sheet 12 is used as a base element including conductor 12*a*. The upper contact sheet 12 is formed by printing a conductive paste on a polyester film with a similar procedure to that in the lower contact sheet 11. As shown in FIG. 4, the upper contact sheet 12 comprises a conductor 12*a* for supplying an electric current; a through hole 12*c* for receiving the projection portion 6*c* in FIG. 1; through holes 12*d* and 12*e* for receiving the corresponding pins 6*a* and 6*b*; and a through hole 12*f* for receiving the screw 3*a*.

The conductor 12*a* is constituted in a wiring pattern by a conductor formed on the surface of the upper contact sheet 12. The conductor 12*a* comprises six annular contact areas 12*g* coaxially arranged with respect to the center of the upper contact sheet 12 with the same circumferential spacing; a conductor portion 12*h* formed in the circumferential direction of the upper contact sheet 12 for connecting to the contact areas 12*g*; and an annular conductive area 12*j* connected to the conductor portion 12*h* for receiving the screw 3*a*. As show in FIG. 2, the contact areas 12*g* are disposed so as to face the contact areas 11*g*, and when the contact areas 11*g* and 12*g* receive a press force, the membrane switch turns on in the conductive state. The conductive area 12*j* is disposed to face the contact area 11*g*, as shown in FIG. 2, and is connected to the conductor portion 12*h*, as shown in FIG. 4. The conductive areas 11*j* and 12*j* are fastened so as to come in contact with each other via the screw 3*a* shown in FIG. 1, so that the conductor 11*a* and the conductor 12*a* are always maintained in the conductive state.

The spacer 13 is used as an element for maintaining a predetermined spacing between the conductor 11*a* and the conductor 12*a*. The spacer 13 is interposed between the lower contact sheet 11 and the upper contact sheet 12 and it is made of a polyester film for electrically isolating these contact sheets 11 and 12 from each other. As shown in FIG. 5, the spacer 13 includes a through hole 13*c* for connecting the conductor portion 11*j* and conductor portion 12*j* to each other; through holes 13*d* and 13*e* for receiving the pins 6*a* and 6*b* respectively; and six through holes 13*g* for connecting the contact areas 11*g* and the corresponding contact areas 12*g* to each other. The six through holes are disposed with the same circumferential distance in the same radial distance from the center of the spacer 13.

The connector 14 is used as a connection element for electrically connecting the membrane switch 10 to electric wires, an electrical circuit or an electrical appliance. As shown in FIGS. 2 and 3, the connector 14 is connected to the conductor 11*a* by inserting thereinto one end of the projection portion 11*b* in which the conductor portions 11*i* and 11*k* are formed.

In the following, the function of the membrane switch according to the embodiment of the invention will be described.

Figure 6A:
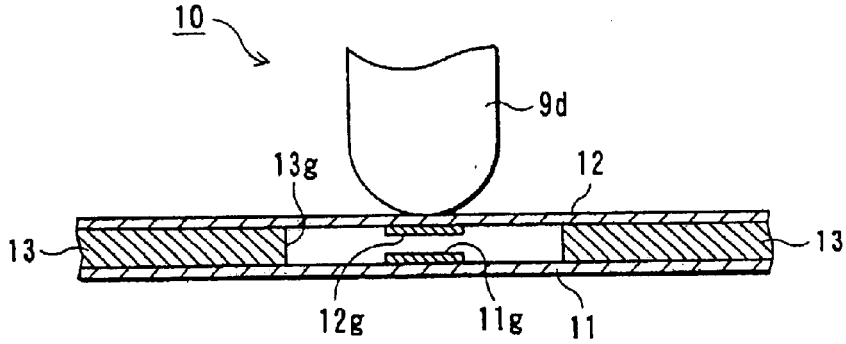
FIG. 6A is a sectional view of the membrane switch according to the invention in the non-conductive state.
Figure 6B:
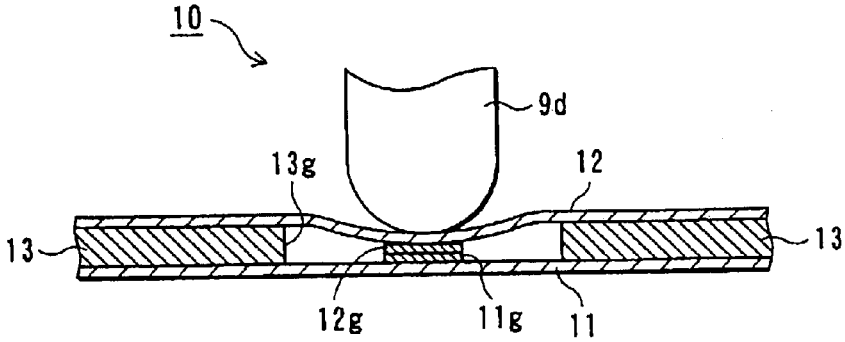
FIG. 6B is a sectional view of the membrane switch according to the invention in the conductive state.
Figure 6C:
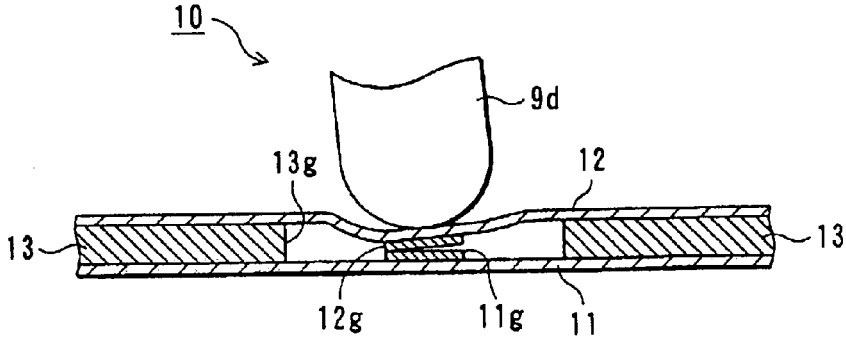
FIG. 6C is a sectional view of the membrane switch according to the invention in the conductive state.

FIG. 6A is a sectional view of the membrane switch according to the invention in the non-conductive state. FIGS. 6B and 6C are sectional views of the membrane switch according to the invention in the conductive state.

As shown in FIG. 6A, when the dial 4 in FIG. 1 is manipulated in the state in which the upper contact sheet 12 is in contact with the projection portion 9*d*, a load or a press force resulting from the contact with the dial 4 is transmitted from the projection portion 4*a* to the projection portion 9*d* via the force transmission element 9. As a result, the projection portion 9*d* moves the upper contact sheet 12 downward by the press force applied thereto, as shown in FIG. 6B, so that the upper contact sheet 12 is bent and the contact areas 11*g* and the corresponding contact areas 12*g* are into contact with each other. As shown in FIGS. 2–4, the conductor 11*a* having the contact area 11*g* and the conductor 12*a* having the contact area 12*g* come into contact with each other via the conductive area 11*j* and conductive area 12*j*. As a result, the conductors 11*a* and 12*a* are always maintained in the conductive state. Hence, the contact of the contact areas 11*g* with the corresponding contact areas 12*g* causes the membrane switch 10 to be in the conductive state (ON).

When a load resulting from the touching of the dial 4 is so small as to provide a restricted contact between the contact areas 11*g* and 12*g*, as shown in FIG. 6C, the membrane switch 10 becomes in the conductive state (ON) as similarly to the case in FIG. 6B.

A decrease in the load or the press force applied to the projection portion 9*d* causes the projection portion 9*d* to be moved upward by the resilient force of the upper contact sheet 12, and to be returned into the initial position. As a result, the membrane switch 10 is transferred into the non-conductive state (OFF).

The membrane switch according to the embodiment of the invention has the following advantages:

(1) In accordance with the embodiment, the conductive areas 11*j* and 12*j* enable the conductors 11*a* and 12*a* to be in contact with each other and therefore to be always maintained in the conductive state. When a press force is applied to the contact areas 11*g* and 12*g* in the conductors 11*a* and 12*a* in such manner that they come into contact with each other in a small area, the membrane switch 10 turns on into the conductive state. As a result, in the operation of the membrane switch 10 according to the embodiment of the invention, no such large load is needed, as in the conventional membrane switch 110, where a large load has to be applied between the contact area 112*a* and the ramified contact areas 111*c* and 111*d*, and therefore turns on in the conductive state by applying a very small press force in touch sense, thereby enabling the reliability in the operation to be greatly enhanced. In the membrane switch 10, moreover, there is no need for firmly applying a resilient projection portion 109*d* to the upper contact sheet 112 in the conventional membrane switch 110, thereby enabling the number of parts to be reduced as well as the production cost to be reduced.

Figure 7:
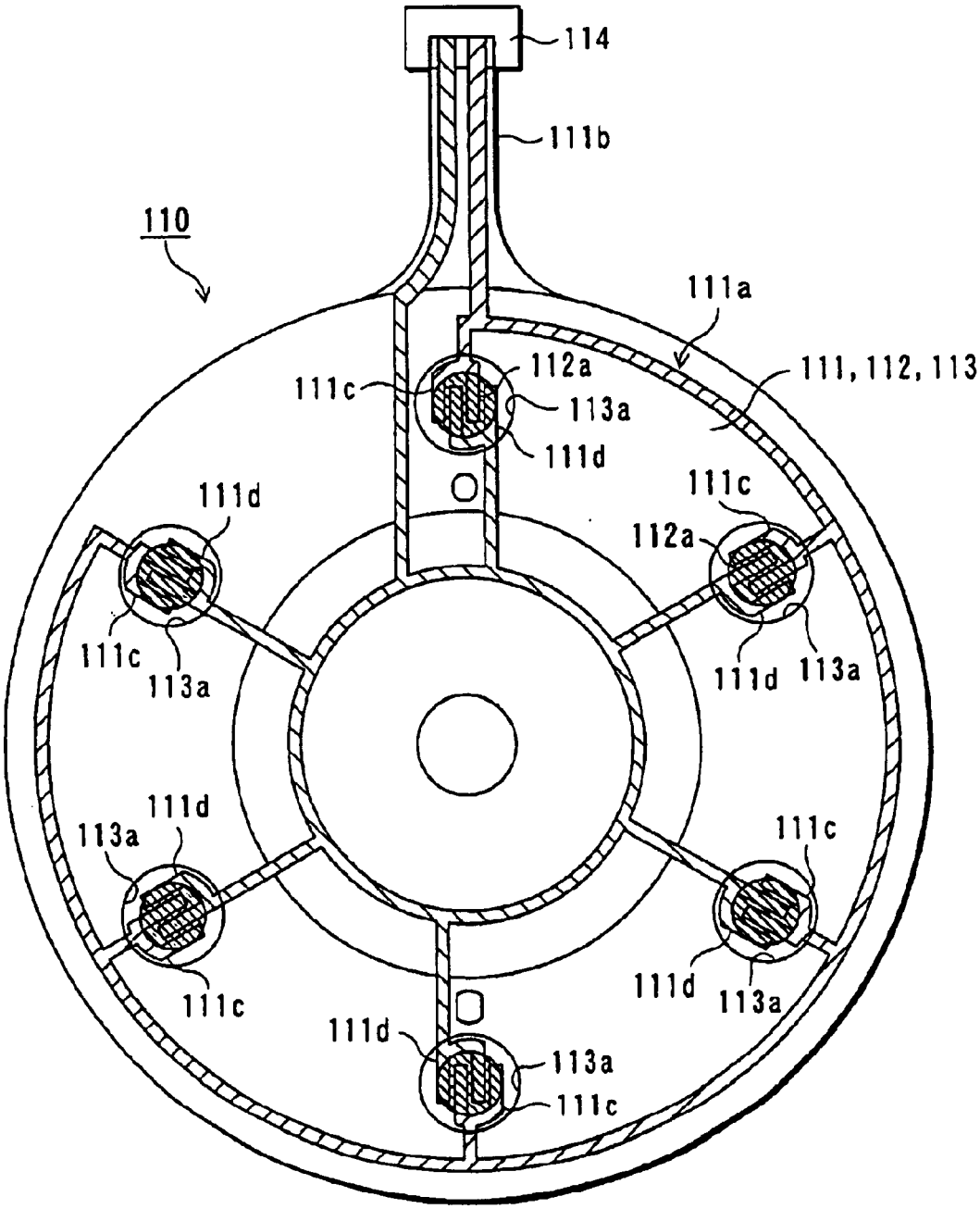
FIG.7 (PRIOR ART)
FIG. 7 is a plan view of a conventional membrane switch.
Figure 8:
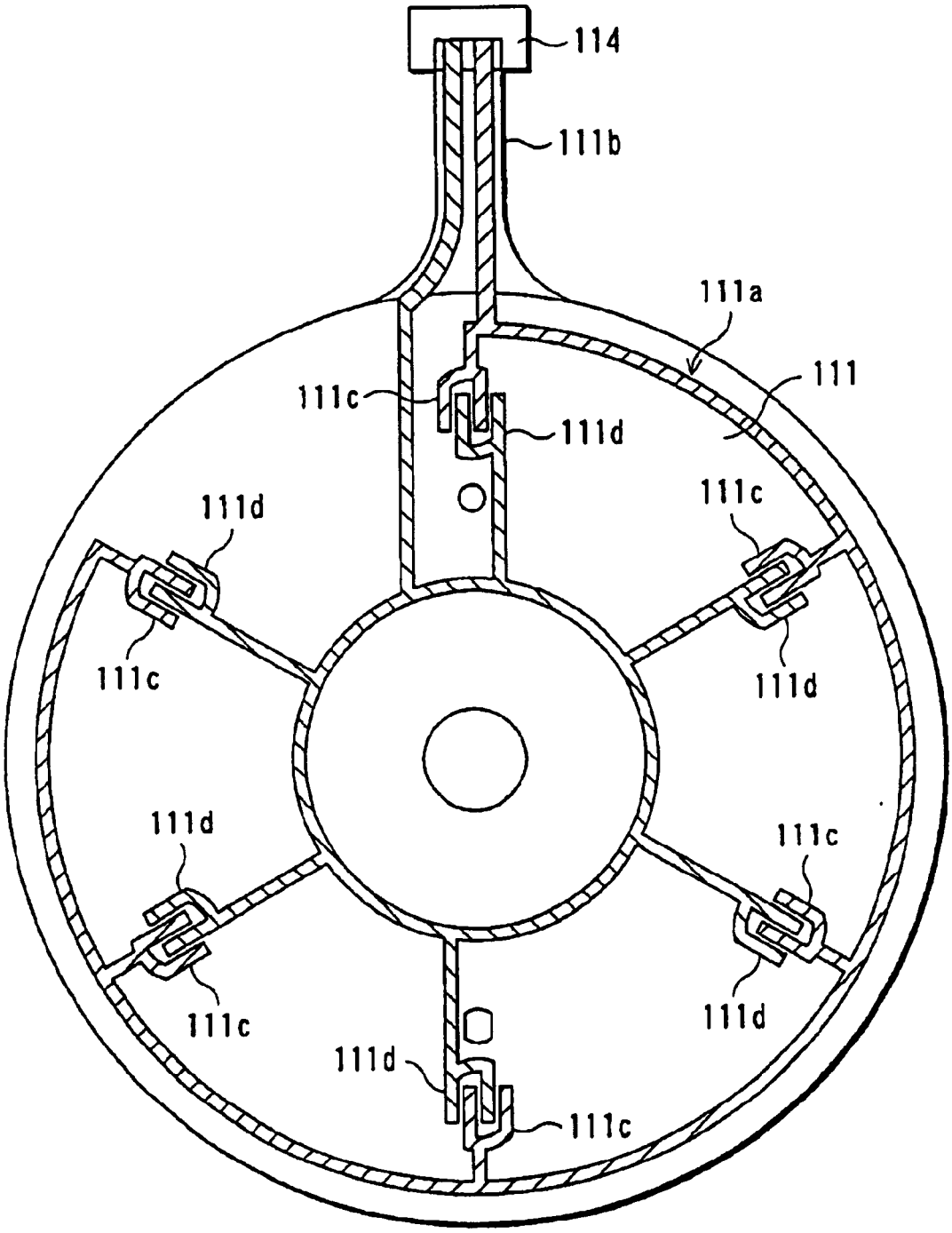
FIG. 8 (PRIOR ART)
FIG. 8 is a plan view of a lower contact sheet in the conventional membrane switch.
Figure 9:
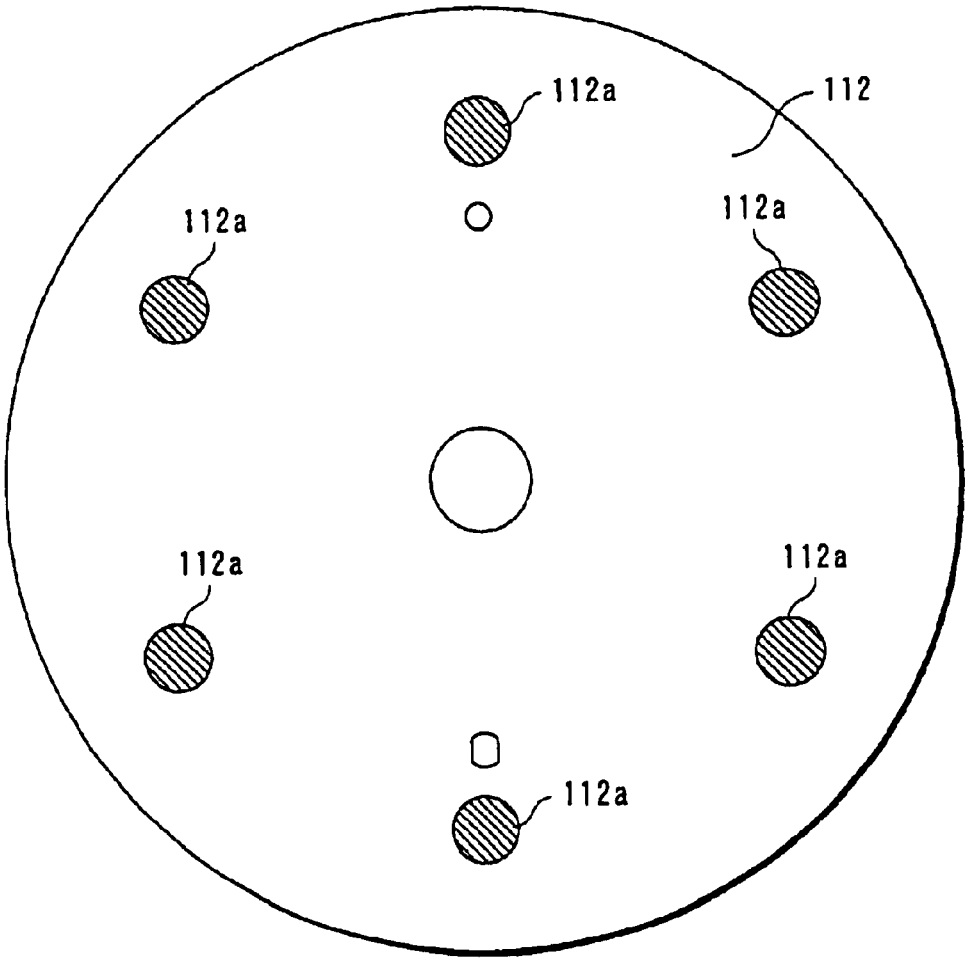
FIG.9 (PRIOR ART)
FIG. 9 is a plan view of an upper contact sheet in the conventional membrane switch.
Figure 10A:
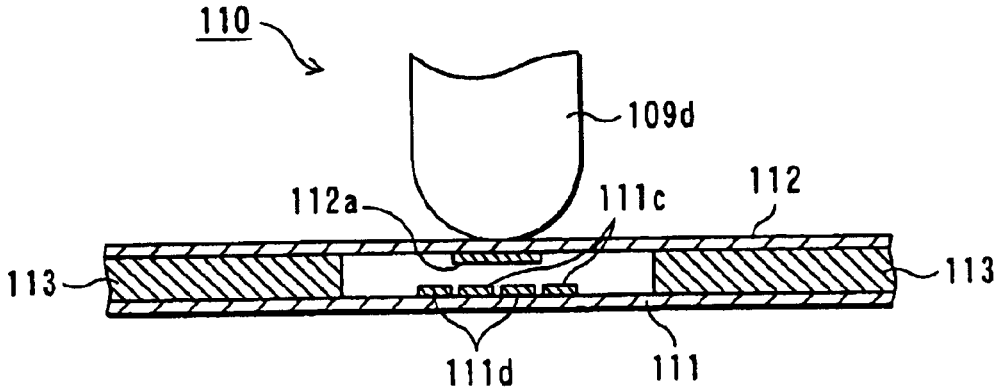
FIG.10(A) (PRIOR ART)
FIG. 10A is a sectional view of the conventional membrane switch in the non-conductive state.
Figure 10B:
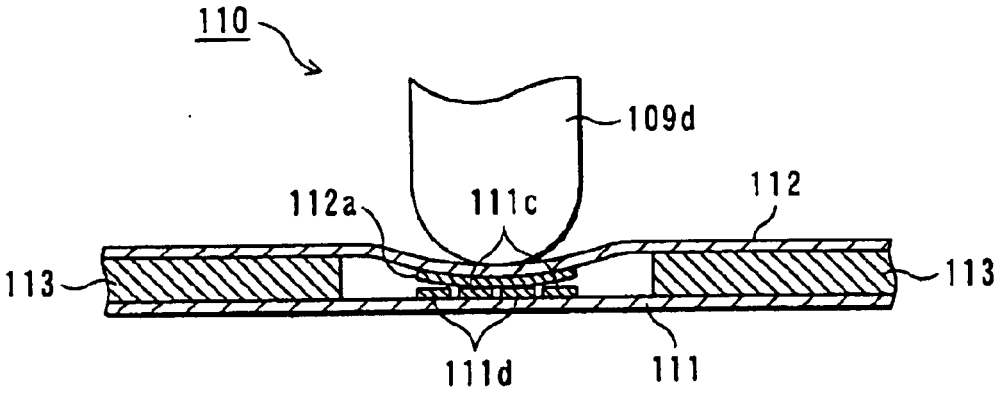
FIG.10(B) (PRIOR ART)
FIG. 10B is a sectional view of the conventional membrane switch in the conductive state.

(2) In accordance with the embodiment, the contact areas 12*g* are always connected to the conductive area 11*j* and, along with this arrangement, the membrane switch turns on, when at least one of the contact areas 11*g* and the contact area 12*g* corresponding thereto come into contact with each other. Due to this arrangement, the connector 14 of the membrane switch 10 is compatible with the connector 114 of the conventional membrane switch 110 shown in FIG. 7. Accordingly, this arrangement ensures an easy connection of the connector, compared with the arrangement in which two connectors are connected to the conductor 11*a* and 12*a*, respectively. In case of trying to form a connector 14 by extending the conductor portion 11*i* from the contact areas 12*g*, contacts of the connector have to be disposed in both the lower contact sheet 11 and the upper contact sheet 12, thereby lacking the compatibility with the conventional connector regarding the contacts.

(3) In accordance with the embodiment, the contact areas 11*g* and 12*g* are disposed with the same circumferential spacing on a circle from the centers of the lower contact sheet 11 and the upper contact sheet 12, respectively. As a result, the membrane switch 10 turns on steadily in the conductive state, if a soft touch of at least one of the contact areas 11*g* is carried out.

In the above-described embodiment, six contact areas 11*g* and 12*g* are disposed on a circle. However, the number of the contact areas and the spacing therebetween can be arbitrarily selected. In the embodiment, an appropriate spacing can be provided between the contact areas 11*g* and the contact areas 12*g*. Therefore, the press force necessary for contacting the contact areas 11*g* with the contact areas 12*g* can be adjusted by appropriately selecting the thickness of the spacer 13 and the inside diameter of the through holes 13*g*. In the embodiment, moreover, the conductive area 11*j* and the conductive area 12*j* are directly in contact with each other. However, the electrical connection between the conductive areas 11*j* and 12*j* can be attained via an appropriate conductive material. In the embodiment, however, the lower contact sheet 11 and the upper contact sheet 12 are formed by the same material (for instance, polyester). Actually, the upper contact sheet 12 can be formed by a flexible material. In this case, however, it is not necessary that the lower contact sheet 11 and the spacer 13 are formed by a flexible material. In particular, the lower contact sheet 11 must be disposed on a flat surface of a stiff material in order to receive the press force applied to the upper contact sheet. Otherwise, the lower contact sheet 11 itself must be made of a stiff material. In the embodiment, furthermore, the conductor portions 11*i* and 11*k* on the side of the lower contact sheet 11 are connected to the connector 14. However, such conductor portions connected to the connector can be formed on the side of the upper contact sheet. In other words, the geometry of the upper contact sheet 12 and the lower contact sheet 11 can be arranged upside down, such that the contact sheets 11 and 12 are disposed respectively on the upper and lower sides and the contact sheet 12, in which case the lower contact sheet 11 can be made of a flexible material.

While the preferred embodiment has been shown and described, various modifications and substitutions may be made without departing from the spirit and scope of the invention. Accordingly, it is to be understood that the present invention has been described by way of example, and not by limitation.

What is claimed is:

1. A membrane switch comprising:

(a) a first base element made of an electrical insulation elastic material, said first base element having a first conductor including at least one press contact area and at least one permanent contact area on a surface of said first base element;

(b) a second base element made of an electrical insulation material, said second base element having a second conductor and a third conductor on a surface facing said surface of said first base element, said second conductor including at least one press contact area in accordance with the arrangement of said at least one press contact area in said first conductor, and said third conductor including at least one permanent contact area in accordance with the arrangement of said at least one permanent contact area in said first conductor, said second base element further having a connector section for connecting said second and third conductors to an external circuit; and (c) a spacer made of an electrical insulation material, said spacer being interposed between said first base element and said second element, said spacer having through holes at positions corresponding to those both in said at least one press contact area and said at least one permanent contact area of said first and second base elements.

2. A membrane switch comprising:

(a) a first base element made of an electrical insulation elastic material, said first base element having a first conductor including at least one press contact area, a second conductor including at least one permanent contact area and a connector section for connecting said first and second conductors to an external circuit on a surface of said first base element;

(b) a second base element made of an electrical insulation material, said second base element having a third conductor on the surface facing said surface of said first base element, said third conductor including at least one press contact area in accordance with the arrangement of said at least one press contact area disposed in said first conductor and at least one permanent contact area in accordance with the arrangement of said at least one permanent contact area disposed in said first conductor; and (c) a spacer made of an electrical insulation material interposed between said first base element and said second base element, said spacer having through holes in accordance with the arrangement of said at least one press contact area and said at least one permanent contact area.

3. A dial operation member comprising:

(a) a shaft;

(b) a bearing through which said shaft passes;

(c) a dial body fixed to said shaft and rotatably supported around the center axis of said shaft;

(d) a press member for switch disposed so at to face said dial body for switching, said press member having at least one press projection portion for switching; and (e) a membrane switch according to claim 1 or 2, wherein at least one press portion for switching is disposed so as to face said at least one press projection for switching in said press member for switch.

* * * * *